United States Patent [19]

Aho et al.

[11] 4,253,773

[45] Mar. 3, 1981

[54] FLUID CONTAINER

[75] Inventors: Kenneth A. Aho, Chisago; Francis M. Farrell, III, Grant Township, Washington County, both of Minn.

[73] Assignee: Minnesota Mining and Manufacturing Company, St. Paul, Minn.

[21] Appl. No.: 67,958

[22] Filed: Aug. 20, 1979

[51] Int. Cl.[3] ..... B01F 7/00

[52] U.S. Cl. ..... 366/247; 206/219; 206/222; 366/290

[58] Field of Search ..... 206/219, 222; 215/DIG.8; 366/245, 247, 290

[56] References Cited

U.S. PATENT DOCUMENTS

| | | | |
|---|---|---|---|
| 3,134,577 | 5/1964 | Bollmeier | 206/222 |
| 3,349,966 | 10/1967 | Schwartzman | 206/222 |
| 3,586,296 | 6/1971 | Svantehrilbe et al. | 366/290 |
| 3,715,189 | 2/1973 | Nighohossian et al. | 206/222 |
| 3,870,147 | 3/1975 | Orth | 206/222 |
| 4,010,934 | 3/1977 | McCord et al. | 366/247 |

FOREIGN PATENT DOCUMENTS

| | | | |
|---|---|---|---|
| 2628694 | 12/1977 | Fed. Rep. of Germany | 206/222 |

*Primary Examiner*—Joseph Man-Fu Moy

*Attorney, Agent, or Firm*—Cruzan Alexander; Donald M. Sell; James V. Lilly

[57] ABSTRACT

A container for shipping, storing and mixing at least two fluids has a covered cylindrical outer container for containing a first fluid and a coaxial, smaller diameter inner container for the second fluid. The inner container is closed at the end adjacent the cover of the outer container by a piston and at the opposite end by a removable seal. A plurality of mixing blades are spaced around the inner container and are coupled to a drive plate in the cover of the outer container for rotation therewith. The drive plate has an axial opening for a pusher rod to enter and push the piston down the inner container to expel the second fluid into the first fluid in the outer container, the fluids then being mixed by rotation of the drive plate.

9 Claims, 6 Drawing Figures

FLUID CONTAINER

FIELD OF THE INVENTION

The present invention relates to a container for shipping, storing and mixing at least two fluids.

BACKGROUND OF THE INVENTION

The prior art has provided various ways for shipping and storing two components in a compartmented container which components are to be mixed prior to use. Such containers are disclosed in U.S. Pat. Nos. 3,134,577; 3,464,414; 3,684,136; 3,715,189; and 3,951,387. U.S. Pat. No. 3,715,189 further discloses such a container in which the inner container is smaller in diameter and coaxial with the outer container and a piston in the inner container expels the fluid from the inner container into the outer container for mixing. However, that container provides no means for mixing the contents and space must be left for mixing the fluids by shaking the container. This is disadvantageous since wasted space must be shipped and stored and since, especially with larger quantities of fluids, mixing is not easily accomplished by shaking the container.

SUMMARY OF THE INVENTION

The container of the present invention provides for shipping, storing and mixing of at least two fluids. It includes a cylindrical outer container for containing a first fluid, which outer container has a cover. A cylindrical inner container for containing a second fluid has a smaller diameter than the outer container and is positioned coaxially with the outer container. The end of the inner container adjacent the cover of the outer container is closed by a piston and the opposite end is closed by an end seal that is removable under the pressure of fluid in the inner container when the piston is moved down the inner container. The inner container is so formed and supported within the outer container as to permit removal of the end seal and expulsion of fluid from the inner container into the outer container upon movement of the piston down the inner container. At least one mixing blade extends radially into the outer container and is rotatable with respect to the outer container about the axis of the inner and outer containers. A circular drive plate is supported for rotation centrally in an opening in the outer container cover. The drive plate has an axial opening permitting communication therethrough to said piston in said inner container by a pusher rod for expelling fluid from the inner container into the outer container. The drive plate is also formed with means coupling the drive plate to the mixing blades for rotation together.

THE DRAWING

Figure 1:
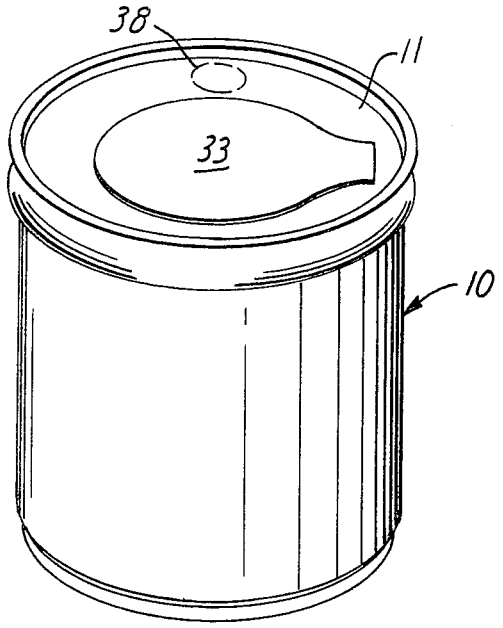
FIG. 1 is a perspective view of a container constructed in accordance with the present invention.
Figure 2:
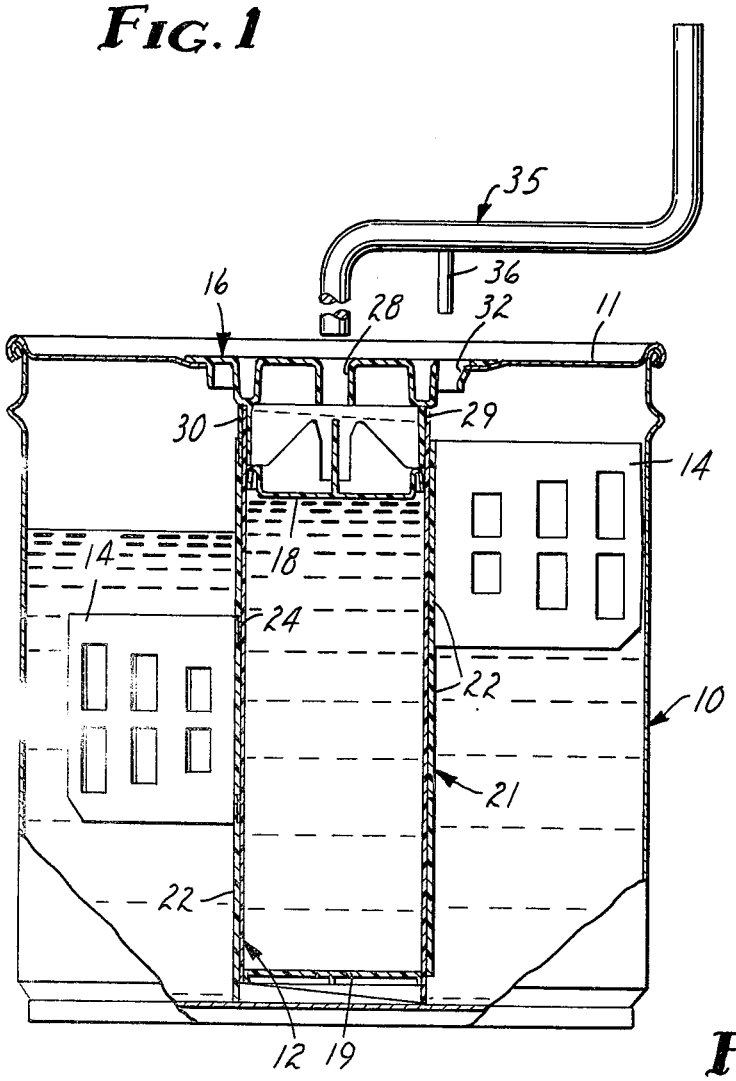
FIG. 2 is a cross sectional elevation view of the container.
Figure 4:
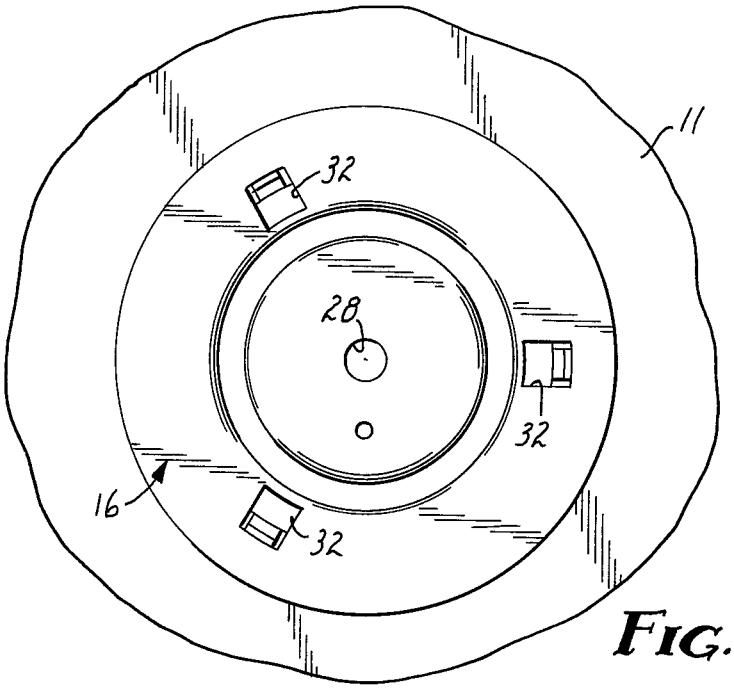
FIG. 4 is a top view of the container after the cover seal has been removed.
Figure 3:
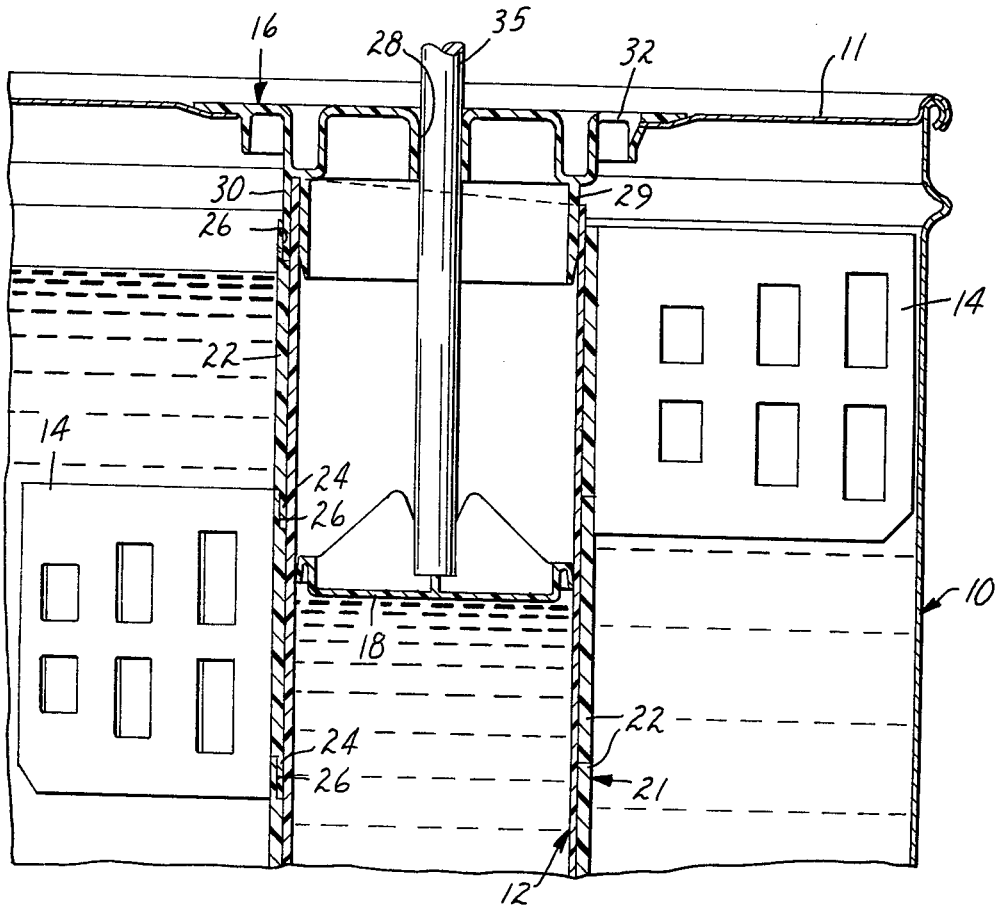
FIG. 3 is a partial cross sectional view similar to that of FIG. 2 after the contents of the inner container have been partially expelled into the outer container.
Figure 5:
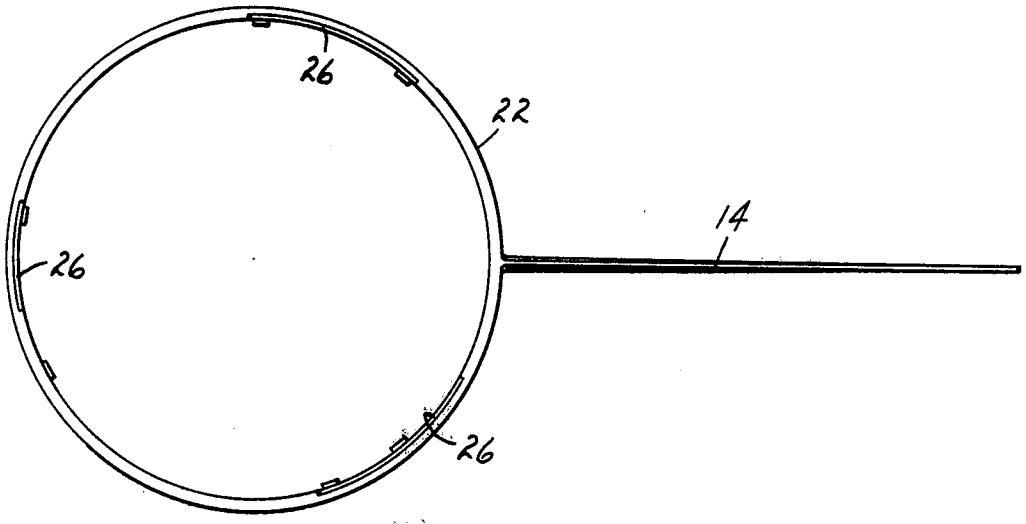
FIG. 5 is a top view of one of the mixing blades which is formed on a cylindrical sleeve segment.
Figure 6:
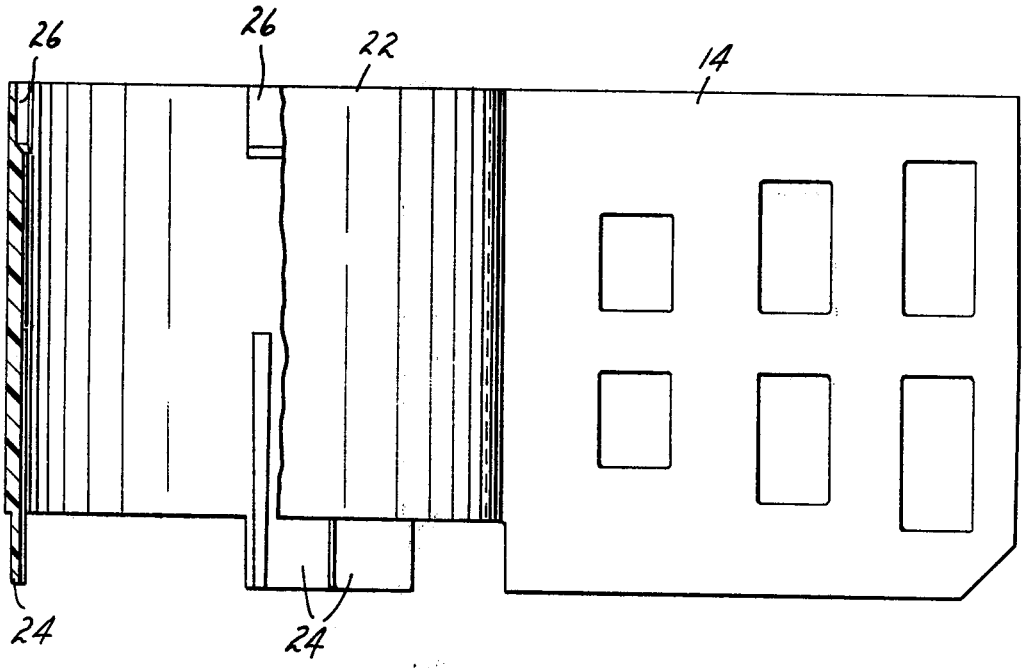
FIG. 6 is a side elevation view, partially in section, of the mixing blade and sleeve segment.

The container of the present invention includes a cylindrical outer container 10 for containing a first fluid and having a cover 11, a cylindrical inner container 12, a plurality of mixing blades 14 spaced around the inner container and a circular drive plate 16 rotatable in the cover 11 and rotatably coupled to the mixing blades 14.

The illustrated outer container 10 is a common covered two gallon tin can in which the cover 11 is formed around its periphery to seal around the top of the sidewall of the container.

The inner container 12 is a cylindrical tube formed, for example, of polypropylene. It has a smaller diameter than the outer container 10 and is positioned coaxially therewith. The end of the inner container 12 adjacent the cover 11 is closed by a piston 18 and the opposite end is closed by a disc shaped end seal 19 force fit into the end of the tubular inner container 12 so that it is removable under the pressure of fluid in the inner container when the piston 18 is moved down the inner container 12. Both the piston 18 and end seal 19 are preferably formed of polypropylene. The ends of the tubular inner container 12 are cut at an angle of 5° to the axis of the tube so that only one point of the tube touches the bottom of the container thereby leaving a space around the remainder of the bottom of the tube for removal of the end seal 19 and expulsion of fluid from the inner container into the outer container 10 upon movement of the piston 18 down the inner container. The inner container 12 may be separated into multiple fluid containing compartments, if desired, by providing separator seals within the tube which may be like the end seal 19.

Three mixing blades 14 are formed on a sleeve 21 closely surrounding the inner container 12 coaxial therewith. The blades 14 extend radially into the outer container 10 and are rotatable with the sleeve with respect to the outer container 10 about the axis of the inner and outer containers. Each mixing blade 14 is formed on a cylindrical sleeve segment 22 and the segments are keyed together by three axially extending arcuate tabs 24 extending from the bottom of a sleeve segment 22 into three axially extending arcuate slots 26 in the top of the sleeve segment 22 immediately below it. The three mixing blades 14 are positioned at 120° intervals around the axis of the containers. Each mixing blade is formed with several rectangular openings to increase the mixing turbulence when the blades are rotated.

The circular drive plate 16 is preferably formed of polypropylene and it is supported for rotation centrally in an opening in the outer container cover 11. It is formed with an axial opening 28 permitting communication therethrough to the piston 18 in the inner container 12 by a pusher rod for expelling fluid from the inner container 12 into the outer container 10. The drive plate 16 is formed with a coaxial cylindrical extension 29 fitting tightly within the upper end of the inner container 12 to seal the piston containing end of the inner container from fluid in the outer container 10. The drive plate 16 is also formed with three axially extending arcuate coupling tabs 30 spaced at 120° intervals around the cylindrical extension 29 to fit into the arcuate keying slots 26 in the uppermost sleeve segment 22 of the mixing blade sleeve 21 to couple the drive plate 16 to the mixing blades 14 for rotation together. Three generally square vent holes 32 are formed through the drive plate 16 at 120° intervals around its axis.

A removable protective sheet 33 is adhesively bonded to the cover 11 of the outer container 10 completely around the drive plate 16 and is bonded to the drive plate to completely cover the drive plate and prevent discharge of fluid from the outer container 10 through the vent holes 32 in the drive plate.

When it is desired to use the compound, the protective sheet 33 is removed by lifting it from the cover 11. The main shaft of a mixing crank may then be inserted into the central opening 28 in the drive plate 16 and pushed downward to engage and push the piston 18 downward. As the piston 18 is moved downward the pressure developed in the fluid in the inner container 12 expels the end seal 19 from the lower end of the inner container 12 and the fluid in the inner container is discharged into the fluid in the outer container.

When the main shaft of the crank 35 has moved the piston completely to the end of the inner container 12, thereby expelling all of the contents of the inner container into the outer container, a pin 36 on the cross bar of the crank 35 extending parallel to the main shaft of the crank is aligned with and moved into one of the vent holes 32 in the drive plate 16. That vent hole 32 thus forms a receptacle for the pin to rotatably couple the crank to the drive plate 16 and thereby to the mixing blades 14. The crank is then rotated to rotate the mixing blades 14 and mix the two fluids.

After the fluids have been thoroughly mixed the cover 11 may be removed to discharge the contents. Alternatively a knock out 38 may be provided in the cover 11 adjacent its periphery through which the contents may be discharged.

We claim:

1. A container for shipping, storing and mixing at least two fluids, comprising:

a cylindrical outer container for containing a first fluid, said outer container including a cover, a cylindrical inner container for containing a second fluid, said inner container having a smaller diameter than said outer container and being positioned coaxially therewith, the end of said inner container adjacent said cover of said outer container being closed by a piston and the opposite end being closed by an end seal that is removable under the pressure of fluid in said inner container when said piston is moved down said inner container, said inner container being so formed and supported within said outer container as to permit removal of said end seal and expulsion of fluid from said inner container into said outer container upon movement of said piston down said inner container, at least one mixing blade extending radially into said outer container and being rotatable with respect to said outer container about the axis of said inner and outer containers, a circular drive plate supported for rotation centrally in an opening in said outer container cover, said drive plate having an axial opening permitting communication therethrough to said piston in said inner container by a pusher rod for expelling fluid from said inner container into said outer container and being formed with means coupling said drive plate to said mixing blade for rotation together.

2. The container of claim 1 wherein there are a plurality of mixing blades spaced around said inner container and rotatable together.

3. The container of claim 2 wherein said mixing blades are formed on a cylindrical sleeve closely surrounding said inner container and being coaxial therewith.

4. The container of claim 3 wherein said cylindrical sleeve is formed of a plurality of cylindrical segments formed with means connecting them for rotation together.

5. The container of claim 3 wherein the end of said sleeve adjacent said cover is formed with axially extending slots and said drive plate is formed with axially extending tabs to rotatably couple said drive plate to said cylindrical sleeve for rotation together.

6. The container of claim 1, 2 or 3 wherein said drive plate is formed with a coaxial cylindrical extension fitting tightly within said inner container to seal the piston containing end of said inner container from fluid in said outer container.

7. The container of claim 1, 2 or 3 including a removable protective sheet adhesively bonded to said cover of said outer container and covering said drive plate.

8. The container of claim 1, 2 or 3 wherein said drive plate is formed with a pin receptacle spaced from said central opening therein for engagement by a pin on the cross bar of a mixing crank after the main shaft of the crank is inserted into said central opening, is moved axially down said inner container and has completely expelled a fluid in said inner container into said outer container.

9. The container of claim 1 wherein said cover of said outer container is removable to permit discharge of the mixed fluids.

* * * * *